US008973663B2

(12) United States Patent
Ringgenberg et al.

(10) Patent No.: US 8,973,663 B2
(45) Date of Patent: Mar. 10, 2015

(54) PUMP THROUGH CIRCULATING AND OR SAFETY CIRCULATING VALVE

(75) Inventors: Paul David Ringgenberg, Frisco, TX (US); Charles Frederick Carder, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 613 days.

(21) Appl. No.: 12/868,555

(22) Filed: Aug. 25, 2010

(65) Prior Publication Data

US 2012/0048564 A1 Mar. 1, 2012

(51) Int. Cl.

| | |
|---|---|
| ***E21B 34/14*** | (2006.01) |
| ***E21B 21/10*** | (2006.01) |
| ***E21B 34/10*** | (2006.01) |

(52) U.S. Cl.

CPC ..... *E21B 21/10* (2013.01); *E21B 34/102* (2013.01)

USPC ..... 166/332.1; 166/319; 166/324

(58) Field of Classification Search

USPC ..... 166/332.1, 319, 324

See application file for complete search history.

(56) References Cited

U.S. PATENT DOCUMENTS

| | | | | | |
|---|---|---|---|---|---|
| 3,071,151 | A | * | 1/1963 | Sizer | 137/496 |
| 3,860,066 | A | * | 1/1975 | Pearce et al. | 166/72 |
| 4,276,937 | A | | 7/1981 | Calhoun et al. | |
| 4,376,464 | A | | 3/1983 | Crow | |
| 4,723,606 | A | | 2/1988 | Vinzant et al. | |
| 4,834,183 | A | | 5/1989 | Vinzant et al. | |
| 5,341,883 | A | * | 8/1994 | Ringgenberg | 166/324 |
| 5,411,097 | A | * | 5/1995 | Manke et al. | 166/324 |
| 5,473,939 | A | | 12/1995 | Leder et al. | |
| 5,819,853 | A | * | 10/1998 | Patel | 166/373 |
| 6,540,025 | B2 | * | 4/2003 | Scott et al. | 166/355 |
| 6,684,950 | B2 | * | 2/2004 | Patel | 166/250.01 |

OTHER PUBLICATIONS

PCT/US2011/048637 International Search Report Jan. 24, 2013. Written Opinion dated Feb. 11, 2013 for Application No. PCT/US2011/048637.

* cited by examiner

*Primary Examiner* — Brad Harcourt
*Assistant Examiner* — Wei Wang
(74) *Attorney, Agent, or Firm* — Chamberlain Hrdlicka

(57) ABSTRACT

According to one embodiment, a recirculation safety valve is disclosed. The valve has a tubular body with mandrel that is axially shifted in response to annulus pressure. Shifting of the mandrel can either close a safety valve or close a safety valve and open a recirculation port. The valve has an annular actuation chamber that relieves that pressure to prevent inadvertent shifting of the mandrel.

19 Claims, 5 Drawing Sheets

PUMP THROUGH CIRCULATING AND OR SAFETY CIRCULATING VALVE

BACKGROUND

Technical Field

The invention relates generally to an apparatus for testing a hydrocarbon well, and, more particularly, to a reverse circulation valve for use with pump through closure or a safety valve operated in response to annulus pressure.

SUMMARY OF THE INVENTION

The present invention provides a closure and circulation valve used in drill stem tests. The invention provides an improved annulus pressure operated closure valve and has a tubular housing with an open bore therethrough and a reverse circulation port in the wall thereof. A tubular valve mandrel assembly is axially shifted in response to annulus pressure to actuate the closure valve to close off flow through the bore. In one embodiment, the mandrel assembly blocks the circulation ports until the mandrel is shifted to close the closure valve and has ports which align with and open the reverse circulation port when the mandrel is shifted. Alternatively, the closure valve can be assembled to include a case that does not contain the recirculation ports.

The valve of the present invention comprises a variable volume actuation chamber to axially shift the valve mandrel in response to increasing annulus pressure. During run in of the tool, a rupture disc blocks a port communicating between the annulus and the actuation chamber. The rupture disc is designed to rupture and open the port to flow in response to pressure in the annulus. The actuation chamber is formed between the valve mandrel and interior of the tool and, when sufficient pressure is applied to the annulus, causes the valve mandrel to shift closing the closure valve and opening the recirculation valve. Redundant or dual seals are provided to seal the actuation chamber. To accommodate gases trapped behind the seals of the actuation chamber, an annular seal ring is configured to vent or act as a check valve in one direction.

A shoulder prevents the valve mandrel from shifting downward and shear pins prevent the valve mandrel from shifting upward. The pins shear when the desired pressure is present in the annulus, thus allowing the valve mandrel to shift upward and operate the valves.

In one embodiment, the closure valve is a flapper-type valve in another it is a ball-type valve. Upward shifting of the valve mandrel in these types of valves is abrupt at high pressure and, accordingly, a large shoulder is present to contact the upper end of the valve to prevent damage.

As used herein, the words "comprise," "have," "include," and all grammatical variations thereof are each intended to have an open, non-limiting meaning that does not exclude additional elements or steps. The terms "up" and "down" are used herein to refer to the directions along the wellbore toward and away from the well head and not to gravitational directions.

BRIEF DESCRIPTION OF THE DRAWING

The drawing is incorporated into and forms a part of the specification to illustrate at least one embodiment and example of the present invention. Together with the written description, the drawing serves to explain the principles of the invention. The drawing is only for the purpose of illustrating at least one preferred example of at least one embodiment of the invention and is not to be construed as limiting the invention to only the illustrated and described example or examples. The various inherent advantages and features of the various embodiments of the present invention are apparent from a consideration of the drawings in which.

DETAILED DESCRIPTION OF THE INVENTION

Figure 1A:
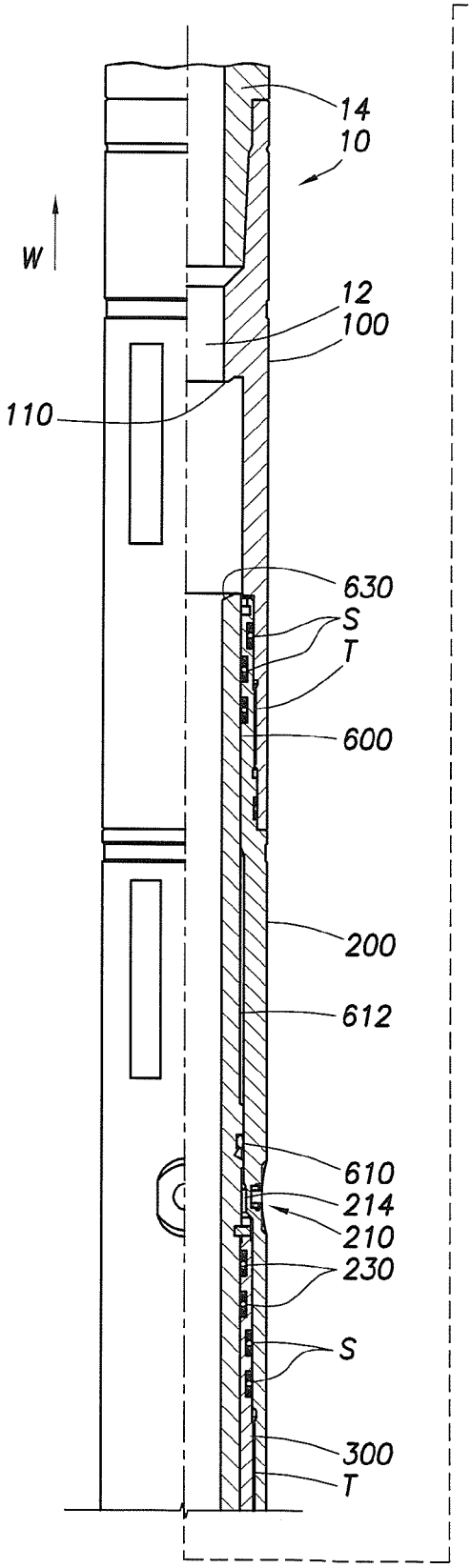
FIG. 1*a-b* is a partial longitudinal section view of the improved, pump through circulating and safety circulating valve in the run position.
Figure 1B:
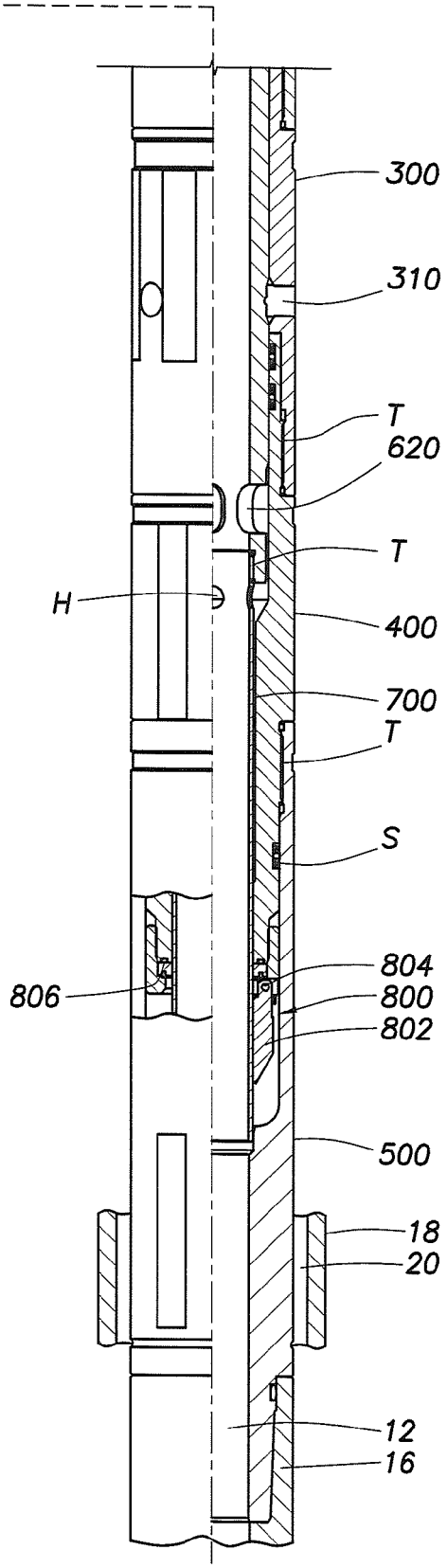

Referring now to the drawings wherein like reference characters designate like or corresponding parts throughout the several views, there is shown in FIGS. 1*a* and *b* the valve assembly 10 of the present invention. The valve assembly 10 is illustrated in FIG. 1 in the run position; that is the position in which the annulus is isolated from the interior chamber of the valve. The valve assembly 10 has an elongated tubular shape for connection into a tubing string 14 and 16. Throughout the several views, an arrow W is used to indicate the orientation of the valve with respect to the well head with the tubing string typically extending to the well head. The valve assembly 10 is typically run installed in the well connected by threads to tubing 14 and 16 and located inside a well casing 18 shown partially in FIG. 1*b*. An annulus 20 is formed inside the casing 18 around the valve assembly 10. The valve assembly 10 has an axially extending central passageway 12 in fluid communication with the tubing string and is positioned above (on the well head side) of a packer (not shown). The passageway 12 is full bore, allowing tools to pass therethrough. "Full bore" as used herein refers to a tool which has a minimum internal dimension (diameter in this case) or drift that substantially is no less than the internal dimension or drift of the tubing string. In this embodiment, the valve assembly has an external shape and size that is substantially the same size and shape as the tubing string.

The valve assembly 10 is run into the well with the valve in the run position shown in FIGS. 1*a-b*. When in position at a subterranean location, the packer is set against the well casing wall, sealing the annulus formed between the outside of the tubing string and the interior wall of the surrounding casing to prevent flow along the annulus past the packer. As will be described in detail hereinafter, when it is desired to activate the valve, pressure is raised in the annulus to move the valve into the circulation position shown in FIGS. 2*a-b*. As will be described when in the circulation position, flow from below the packer through the tubing string is prevented. In addition, recirculation port 310 formed in the wall of the ports case 300 is opened to allow circulation between the interior of the valve assembly 10 and the annulus formed between the casing and the tubing string. With the valve in this position, fluids, such as for example, drilling mud or produced hydrocarbons can be circulated or pumped out of the well either through the annulus or the interior of the tubing string.

The valve assembly 10 as illustrated in FIGS. 1*a*-1*b* comprises seven (7) major subparts. These major subparts comprise: hammer case 100; rupture disc case 200; ports case 300; safety valve adapter 400; bottom adapter 500; upper mandrel 600; and a lower mandrel 700. These subparts 100, 200, 300, 400 and 500 are joined together by mating threads T and form an elongated tubular body. These threaded joints T are sealed with annular seals S and with back-up rings. The joint connecting the rupture disc case 200 and ports case 300 includes two spaced parallel sets of annular seal assemblies S. As will be described, this joint is in fluid communication with the variable volume mandrel actuation chamber. The upper and lower mandrels 600 and 700 are also joined together by threads T and are axially shiftable within the valve assembly. The lower mandrel 700 has a set of circular holes H in its wall for use in threading the two mandrels together. As will be described, the mandrels 600 and 700 act as a piston for actuating the valve assembly and as a valve element for controlling fluid flow.

Figure 3:
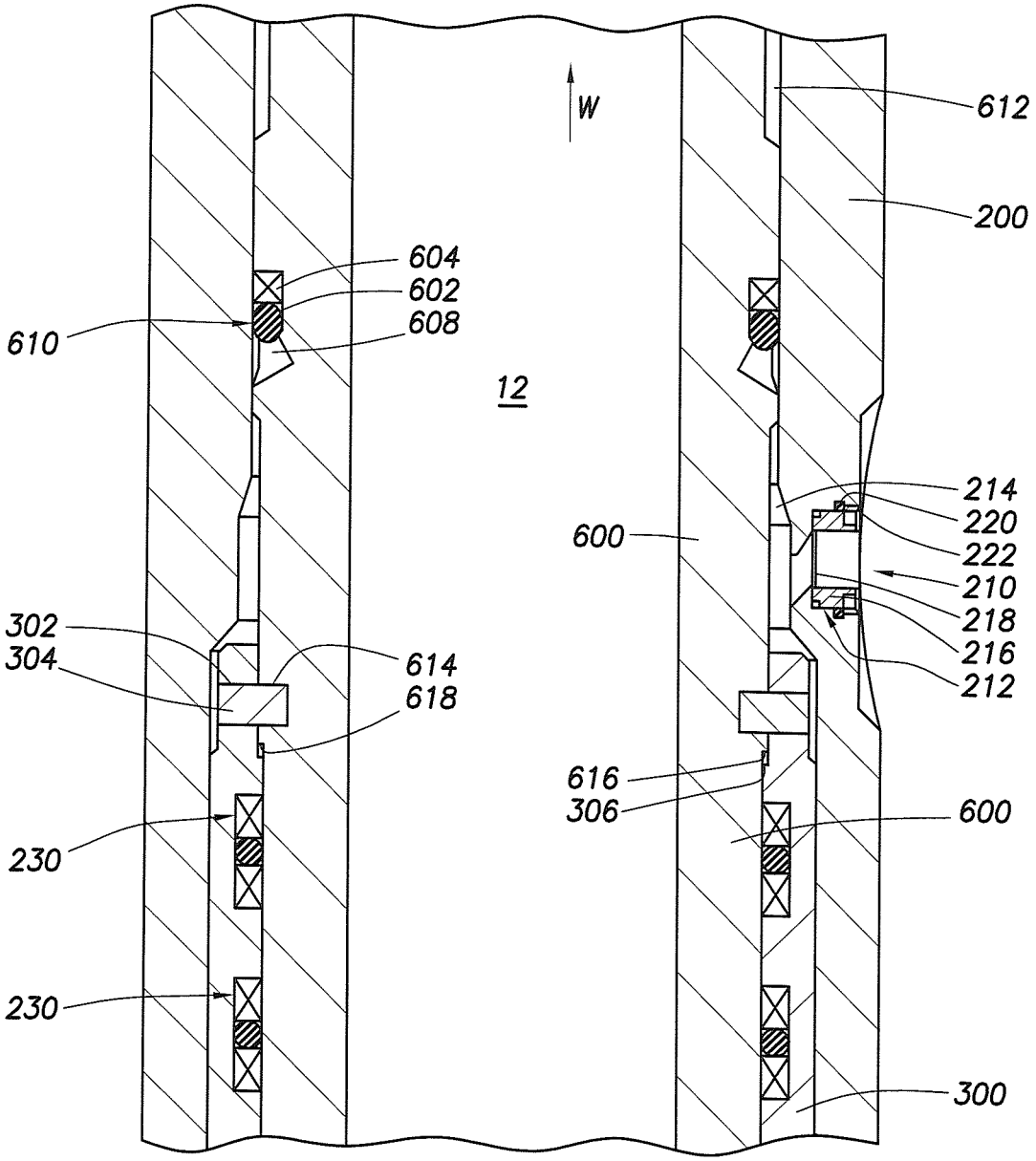
FIG. 3 is an enlarged longitudinal cross-section view of the rupture disk case portion of the valve of the present invention.

Turning to FIG. 3, the details of the structure utilized to shift the mandrels from the run position into the circulation position will be described. A bore or port 212 is formed in the wall of the rupture disc case 200. The port communicates between the exterior of the tool (annulus 20) and a variable volume actuation chamber 214. A rupture disc assembly 216 is mounted in the bore 212 to initially separate the chamber 214 from the exterior of the valve assembly 12. The disc assembly 216 includes a frangible partition extending across the bore 212 and blocking the bore. The partition is supported at its periphery and fails or bursts when force on the partition due to differential pressure across the partition exceeds a set value. An annular seal 220 is mounted in the wall of bore 212 to seal around the assembly 216. Threads mount the assembly 216 in the bore 212. It is envisioned, of course, that the assembly 216 could be mounted in the bore by any means such as snap ring, press fitting or the like. The disc 218 is mounted to close the bore extending through the actuation port assembly 210 and is selected to rupture when a predesigned pressure differential is applied to the disc. The bottom of port 212 is angled downward. This forces the entering fluid to change direction which slows tool operation.

The variable volume chamber 214 is formed in the annular space between the upper mandrel 600 and rupture disc case 200. As illustrated in FIG. 3, the lower end of the chamber 214 is sealed off by two sliding seal assemblies 230 located between case 200 and 300. In the illustrated embodiment, these two seal assemblies comprise annular seals with protective back-up rings mounted in rectangular grooves in the interior wall of ports case 300. Also, as illustrated in FIG. 3, the upper end of the chamber 214 is sealed by a backup ring 604 and seal 602 mounted in a groove 610 formed in the upper mandrel 600. It should be appreciated that as the mandrel translates longitudinally in the valve, the upper and lower seals will move relative to each other varying the volume of the chamber 214.

Figure 4:
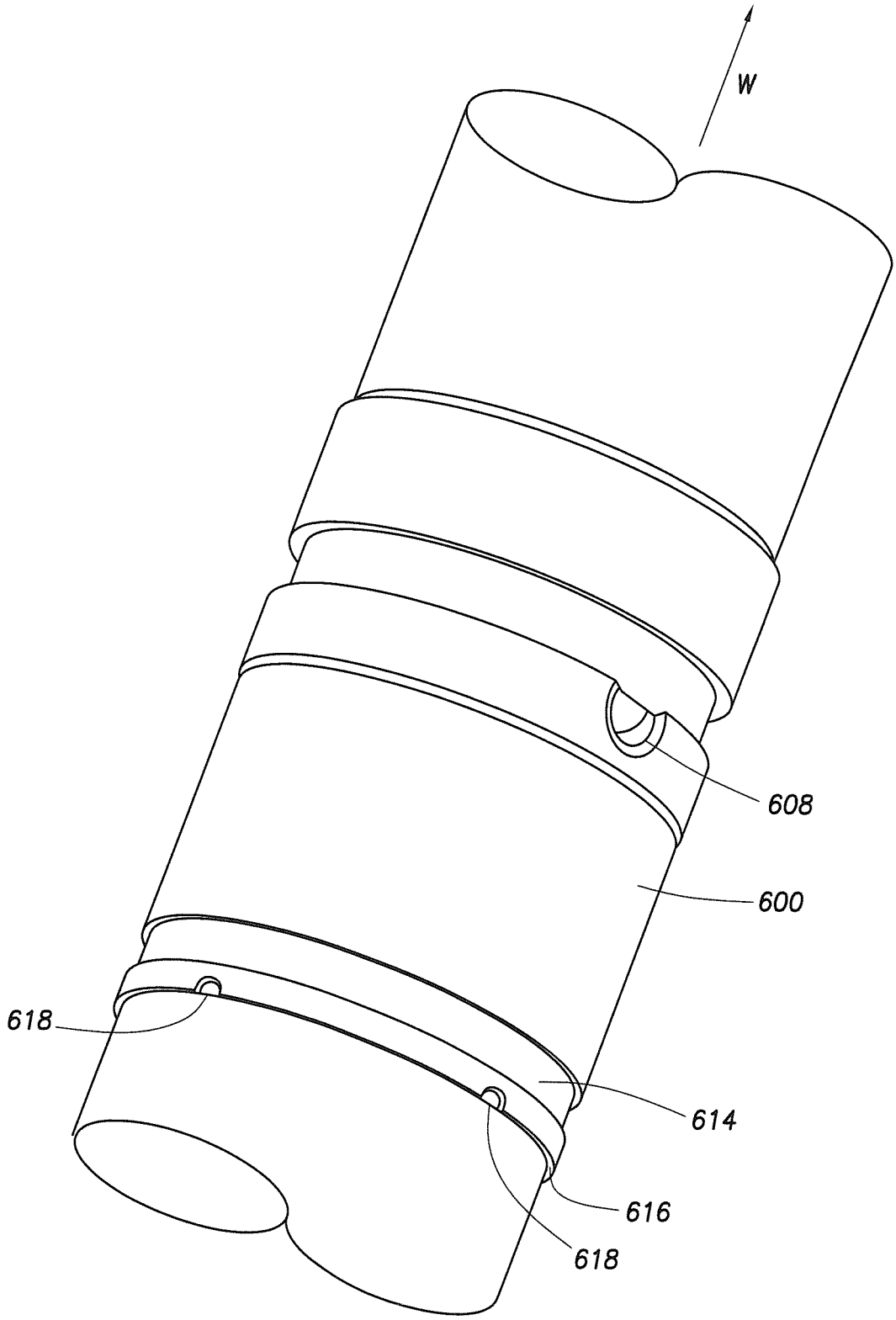
FIG. 4 is an enlarged perspective view of a portion of the upper internal mandrel of the valve of the present invention.

As illustrated in detail in FIGS. 3 and 4, the groove 610 is rectangular shaped with opposing walls and has one or more axially spaced reliefs or recesses 608 formed proximate the groove wall adjacent to and below the seal 602. The seal preferably is a relatively elastically deformable annular seal such as an o-ring of resilient material. The seal tends to extrude into and seal the space around the mandrel. A back-up ring can be provided on the side of the seal 602 away from the reliefs. These reliefs 608 make the seal unidirectional and allow the seal 602 to function like a check valve to relieve pressure trapped in the annular chamber 612 formed above the seal 602. If a pressure differential is present, the seal 602 moves upward against the wall of the groove and seals when the higher pressure is in the chamber 214. If, on the other hand, the higher pressure is in chamber 612, the seal 602 will be deformed into the reliefs 608 where it is unsupported and will allow flow from the chamber 612 into chamber 214. By relieving pressure outside of the chamber 214, undesirable movement of the mandrel is prevented.

This is useful when performing internal pressure testing prior to installation. Pressure build up during testing will be relieved. Also, when the mandrell is activated, pressure in chamber 612 will increase. When the tool is removed from the well, the seal 602 is will deform to relieve the pressure.

A plurality of shear pins 304 are mounted in circumferentially spaced bores 302 in the ports case 300. Pins 304 engage an annular groove 614 (see FIG. 4) in the upper mandrel 600 to prevent the upper mandrel 600 from moving. When sufficient pressure is applied to the annulus, the disc 218 will fracture and shear pins 304 will shear, allowing the upper mandrel 600 to move longitudinally axially shifting in an upward direction as shown in FIG. 2. The number of shear pins installed and the materials thereof can be varied to set a pressure at which the upper mandrel 600 is allowed to move. The mandrel is shaped so that it acts as a piston tending to move the mandrel upward when relative pressure in the chamber 214 is raised.

When the upper mandrel 600 is in the run position shown in FIG. 3, downward movement of the mandrel is prevented. As shown in FIGS. 3 and 4, an annular shoulder 616 on the upper mandrel 600 rests against an annular shoulder 306 on the ports case 300. As illustrated in FIG. 4, a plurality of reliefs 618 are formed in the abutting face of shoulder 616. The shoulder 306 is illustrated as being annular shaped; however, it is envisioned that other shoulder shapes could be used. For example, the mandrel could rest against or contact cylindrical shoulders on pins.

Figure 2A:
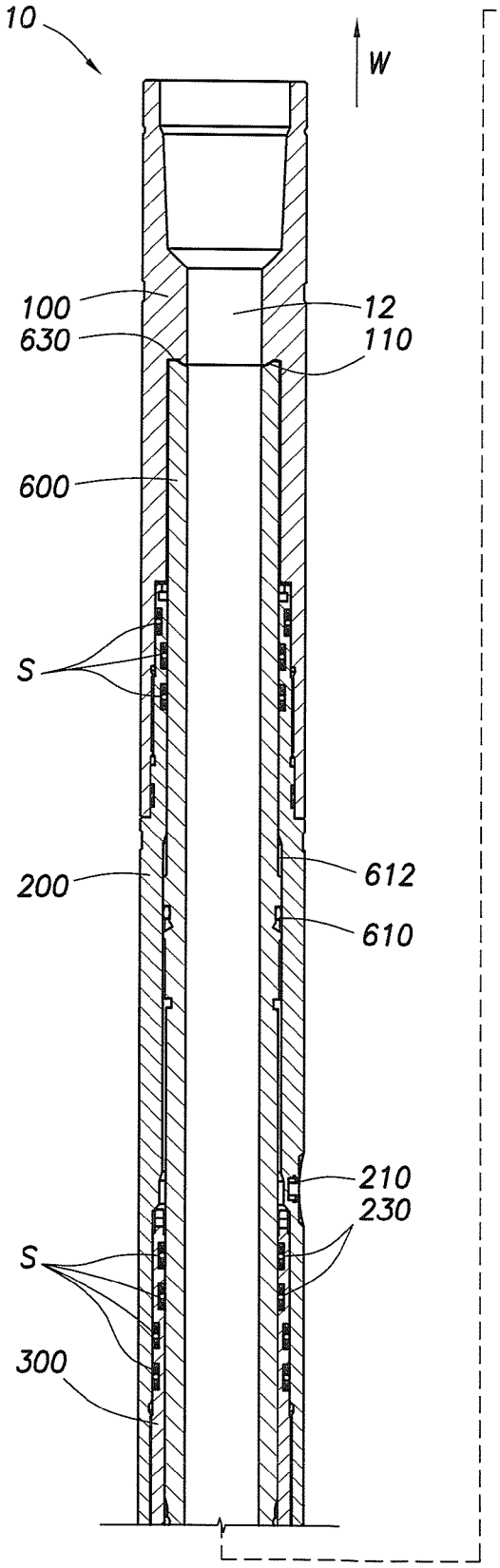
FIG. 2*a-b* is a view similar to FIG. 1 illustrating the valve of the present invention in the circulation position.
Figure 2B:
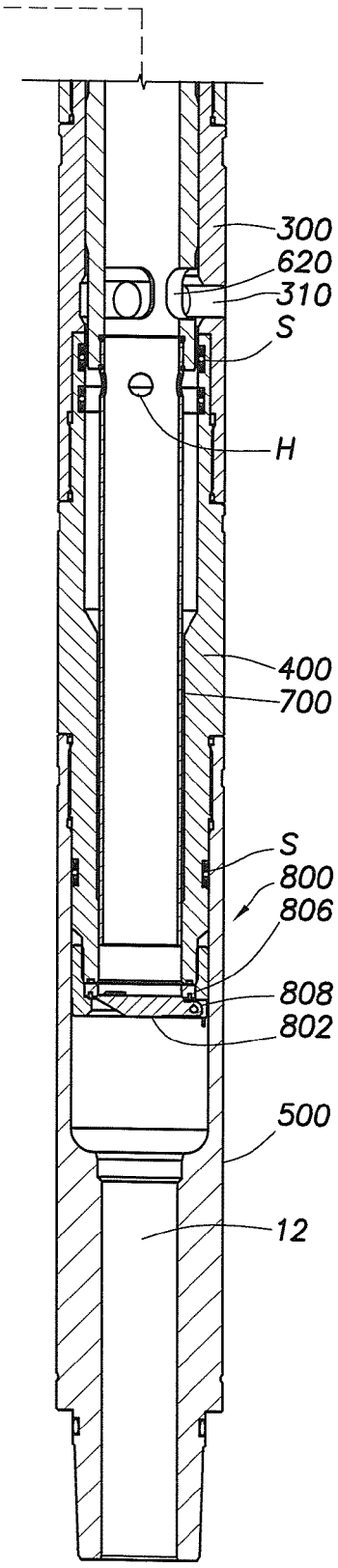

The recirculation features of the valve assembly 10 will be described by reference to FIGS. 1 and 2. As illustrated, a plurality of recirculation ports 310 extends through the wall of the ports case 300. A plurality of corresponding recirculation ports 620 extends through the wall of the upper mandrel 600. When the valve assembly 10 is in the run position as illustrated in FIGS. 1A and 1B, the ports are axially displaced from each other, preventing flow between the passageway 12 and the annulus formed around the valve assembly 10. When annulus pressure has been raised, the disc is fractured, and the pins are sheared, allowing the upper mandrel 600 to act as a valve element and shift axially upward until an annular shoulder 630 on the upper mandrel 600 contacts a downward facing annular shoulder 110 on the hammer case 100. When these shoulders contact, ports 310 and 620 are axially aligned as shown in FIGS. 2A and 2B. In this way, the mandrel acts as a valve element and the port 620 acts as a valve seat which cooperate to allow fluids to be pumped (recirculated) along the annulus 20 through the ports 310 and 620 and into the passageway 12. In an alternate embodiment, the ports case 300 and the flapper adapter 400 are replaced by a unitary part; a no-ports case not illustrated. The no-ports case is formed without recirculation on port 300 therein whereby shifting of the upper mandrel 600 upward to the position shown in FIG. 2, the no-ports case does not allow flow from the passageway 12 and the annulus formed around the valve assembly 1B. According to a particular feature of the invention, the shoulders have corresponding shapes that are not entirely transverse to the direction of the mandrel's movement. As illustrated, the shoulders are generally frusto conical-shaped with the shoulder 630 tapering outward and the shoulder 110 tapering inward. The shoulder 630 forms a bell or recess for receiving the pin-shaped shoulder 110. This configuration reduces the tendency of the shoulders on the mandrel and hammer case from being deformed.

The safety valve features of the valve assembly 10 will be described by reference to FIGS. 1 and 2. As illustrated in FIG. 1, the lower mandrel 700 extends into a safety valve assembly 800. In the present embodiment, the safety valve assembly 800 is a flapper type of valve comprising a flapper-type valve element 802 mounted on a pivot 804 to open and close against a seat 806. As illustrated in FIG. 1, the lower mandrel 700 is operatively associated with the valve assembly 800, in that, the mandrel extends through the safety valve assembly 800 to hold the flapper element 802 in an open position. As is illustrated in FIG. 2, when the upper mandrel 600 and lower mandrel 700 shift upward the shoulders 110 and 630 contact and the lower mandrel 700 is displaced from the flapper 802 of the safety valve 800 allowing the flapper 802 to close against the seat 86. Typically a spring 808 is provided for to urge the flapper 802 in a direction toward the seat 806 to close the valve once the lower mandrel 700 is removed. In this configuration, flow from below the valve and through the passageway 12 is blocked in an upward direction and flow through recirculation ports 310 and 620 is permitted.

Figure 5:
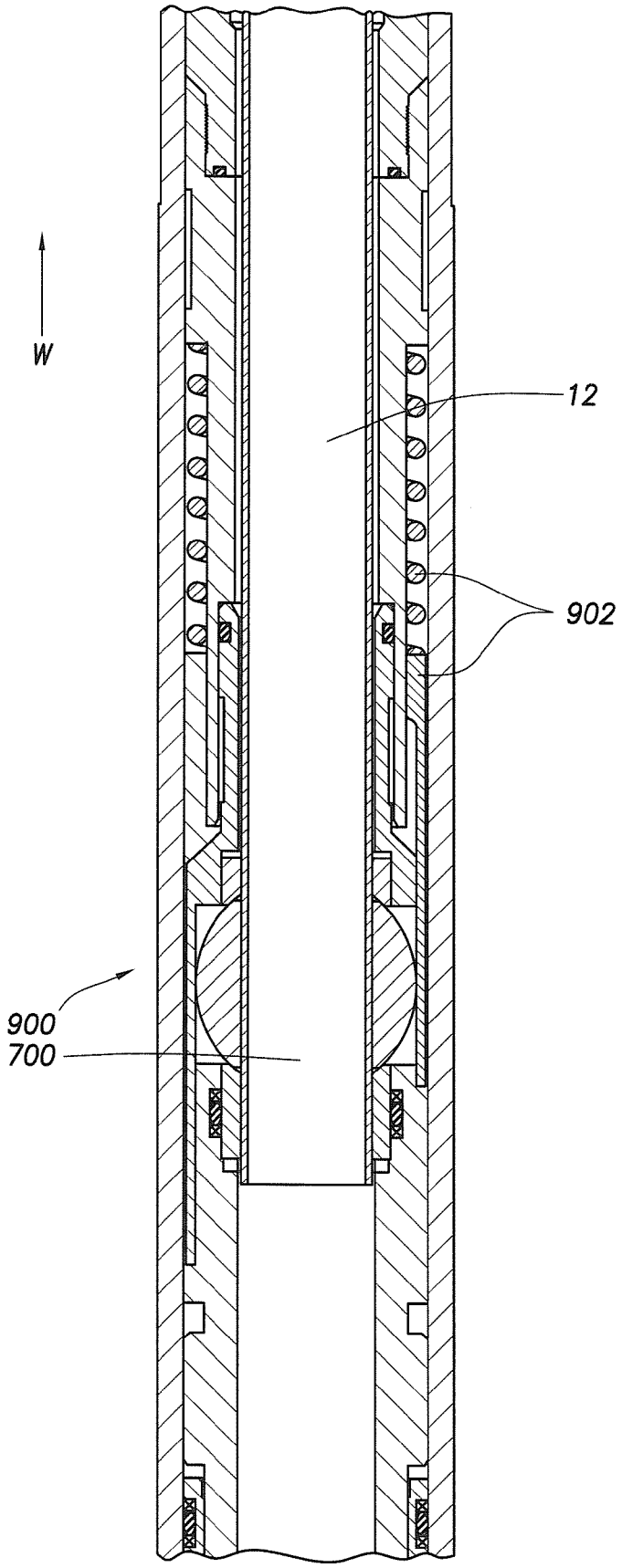
FIG. 5 is a partial longitudinal section view of the ball valve embodiment of the valve to the present invention.

In an alternative configuration illustrated in FIG. 5, a pump through ball-type valve 900 replaces the flapper valve. In this alternate configuration, the ball valve 900 is held open by the lower mandrel 700. The ball valve 900 is urged by spring assembly 902 toward a closed position. Once the mandrel 700 is shifted up out of the ball valve 900, to the position shown in FIG. 2, the ball valve will close. Replacing the flapper valve with a ball-type valve provides an additional feature of allowing fluids to be pumped down the passageway 12 and out into the annulus through recirculation ports 310 and 620.

Also, as previously described, when it is desired to utilize the valve assembly 10 solely as a safety valve; the ports case 300 and the flapper adapter 400 are replaced with a no-ports case that lacks the recirculation port 310. In another option, the safety valve is eliminated, and only the recirculating valve is present.

According to one method of utilizing the present invention, the valve assembly 10 is assembled and connected in a string of tubing at a position above a packer and then run into a cased well. The packer is set to seal off the annulus around the tubing, after which well services or testing steps are performed. When it is desirable to activate the safety valve and/or or open recirculation ports 620, pressures are raised in the annulus sufficient to rupture the disc 200 and to shear the pins 304, forcing the mandrel to shift upward.

Therefore, the present invention is well adapted to attain the ends and advantages mentioned as well as those that are inherent therein. The particular embodiments disclosed herein are illustrative only, as the present invention may be modified and practiced in different but equivalent manners apparent to those skilled in the art, having the benefit of the teachings herein. Furthermore, no limitations are intended to the details of construction or design herein shown, other than as described in the claims below. It is, therefore, evident that the particular illustrative embodiments disclosed above may be altered or modified, and all such variations are considered within the scope and spirit of the present invention.

Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A well tool for use in a tubing string extending to a subterranean location in a hydrocarbon well, comprising:

an elongated, tubular-shaped body for assembly in the tubing string, the tubular body isolating the exterior from the interior of the body;

at least one valve on the body having a valve element movable between an open and a closed position to permit and prevent flow through the valve;

a tubular piston mounted on the body for longitudinal movement with respect to the body, the piston operably associated with the valve element to move the valve element;

a variable volume chamber in an annular space between the body and the piston, a passageway in the body providing fluid communication between the chamber and the exterior of the body;

seals between the body and piston sealing pressure within the chamber during longitudinal movement of the piston, and wherein at least one of said seals is a unidirectional seal, preventing flow of the fluids out of the chamber and permitting flow into the chamber; and wherein the unidirectional seal comprises an annular seal mounted in a groove surrounding the piston, and wherein at least one circumferentially discontinuous recess is formed in the groove.

2. The well tool of claim 1, wherein the at least one valve is movable between an open position wherein flow is permitted through a central bore of the body and the tubing string, and a closed position wherein such flow is blocked.

3. The well tool of claim 1, wherein the at least one valve is movable between an open position wherein flow is permitted through a radial port in the body between a central bore of the body and the exterior of the body.

4. The well tool of claim 1, additionally comprising at least one frangible pin connecting the piston to the body to initially prevent longitudinal movement of the piston in the body.

5. The well tool of claim 1, additionally comprising a frangible partition initially closing the passageway in the body providing fluid communication between the chamber and the exterior of the body.

6. The well tool of claim 1, wherein pressure acting on a first side of the unidirectional seal produces a force on the unidirectional seal which wedges the seal into a sealing engagement position, and pressure acting on an opposite second side moves the unidirectional seal out of sealing engagement position.

7. The well tool of claim 6, additionally comprising a back-up ring on the side of the unidirectional seal away from the recess.

8. A well tool for use in a tubing string extending to a subterranean location in a hydrocarbon well, comprising:

an elongated, tubular-shaped body for assembly in the tubing string with one end positioned toward the wellhead, the tubular body isolating the exterior from the interior of the body;

at least one tubular shaped valve on the body, the valve having a valve element movable between an open and a closed position to permit and prevent flow through the valve;

a tubular piston mounted on the body for longitudinal movement in the body, the piston operably associated with the valve element to move the valve element between the open and the closed position;

a variable volume chamber defined in an annular space between the body and piston;

a first radial passageway in the body providing fluid communication between the chamber and the exterior of the body; a second radial passageway in the body providing communication between the interior and exterior of the body and wherein said valve element is a tubular member that moves longitudinally between the closed position that blocks the second radial passageway and the open position that opens the second radial passageway in the body providing communication between the interior and exterior of the body;

a frangible partition closing the passageway in the body providing fluid communication between the chamber and the exterior of the body;

seals between the body and piston, sealing pressure within the chamber during axial movement of the piston; and wherein at least one seal comprises an annular seal mounted in a groove surrounding the piston, and wherein at least one circumferentially discontinuous recess is formed at one wall of the groove.

9. The valve according to claim 8 additionally comprising a second valve for controlling flow through a central bore of the body.

10. The valve according to claim 9 wherein the second valve comprises a flapper-type valve element, selectively permitting and blocking longitudinal flow through the body and tubular string.

11. The valve of claim 8 additionally comprising at least one frangible pin, connecting the piston to the body to initially prevent longitudinal movement of the piston in the body.

12. The valve of claim 11 wherein the at least one frangible pin is configured to break when pressure in an annular space outside the body rises to exceed a predetermined value.

13. The valve of claim 8 additionally comprising a frangible partition, initially closing the first radial passageway in the body providing fluid communication between the chamber and the exterior of the body.

14. The valve of claim 13 wherein the frangible partition is configured to break in response to a predesigned pressure differential.

15. The valve of claim 13 wherein the frangible partition is configured to prevent fluid flow during run in of the tool and to break when differential pressure across the partition exceeds a predesigned value to shift the valve from the closed position to an open position.

16. The valve of claim 13 wherein the frangible partition comprises a rupture disc.

17. The valve of claim 8 wherein pressure acting on a first side of said annular seal produces a force on said seal which wedges said seal into a sealing engagement position, and pressure acting on an opposite second side moves said seal out of said sealing engagement position.

18. The valve of claim 8 additionally comprising a back-up ring on the side of the annular seal away from the recess.

19. The valve of claim 8, a valve on the body having a valve element movable between an initial, run-in open position permitting flow through a central bore of the body and a closed position preventing flow through the central bore.

* * * * *